United States Patent [19]

Bliss

[11] 4,253,284

[45] Mar. 3, 1981

[54] FOLDABLE AND CURVILINEARLY EXTENSIBLE STRUCTURE

[75] Inventor: Robert L. Bliss, Salt Lake City, Utah

[73] Assignee: University of Utah, Salt Lake City, Utah

[21] Appl. No.: 47,961

[22] Filed: Jun. 11, 1979

[51] Int. Cl.[3] ..... E04H 12/18

[52] U.S. Cl. ..... 52/109; 52/641; 52/648

[58] Field of Search ..... 52/109, 641, 646, 80, 52/81

[56] References Cited

U.S. PATENT DOCUMENTS

| | | | |
|---|---|---|---|
| 3,185,164 | 5/1965 | Pinero | 52/646 |
| 3,375,624 | 4/1968 | Mikulin | 52/109 |
| 3,771,274 | 11/1973 | Vaughan | 52/646 |
| 3,968,808 | 7/1976 | Zeigler | 52/109 |
| 4,115,975 | 9/1978 | Bliss | 52/646 |

*Primary Examiner*—James A. Leppink
*Assistant Examiner*—Henry E. Raduazo

[57] ABSTRACT

A foldable and curvilinearly extensible structure fabricated from a plurality of foldable and extensible base modules. Each base module is fabricated from six rigid members swivelly connected end-to-end in a closed figure with intersecting rigid members being pivotally connected. The length of the first and fourth rigid members is selectively predetermined to provide the overall triangular configuration of the structure with a generally isosceles triangular configuration. Importantly, the placement of pivots in the second and fifth rigid members and the third and sixth rigid members is predetermined by the length to the midpoint of the first and fourth rigid members. A plurality of base modules are selectively interconnected at adjacent swivels to thereby provide the enlarged, foldable and curvilinearly extensible truss-like structure. A plurality of base modules may be selectively interconnected side-by-side and also in an end-to-end configuration to form an elongated, three-dimensional structure which folds into a relatively flat profile while, simultaneously, being extensible at a relatively high ratio and in a generally curvilinear contour. The respective rigid members can also be configurated as curved rigid members to thereby provide a generally toroidal contour to the curvilinearly extensible structure.

10 Claims, 10 Drawing Figures

FOLDABLE AND CURVILINEARLY EXTENSIBLE STRUCTURE

BACKGROUND

1. Field of the Invention

This invention relates to a foldable and extensible structure and, more particularly, to a foldable and curvilinearly extensible structure and method, the structure fabricated from a plurality of base modules, each base module being configurated from six rigid members flexibly interconnected end-to-end by swivels in a closed configuration generally approximating a double isosceles triangle in appearance when folded flat and having intersecting rigid members pivotally secured with the location of one pivot at the midpoint of the base of the isosceles triangle as defined by the respective rigid members and the other two pivots offset from the swivels adjacent the base by a distance equal to one-half the base to thereby impart a desired external contour to the curvilinear configuration and to provide the desired folding and unfolding characteristics.

2. The Prior Art

Extensible structures are well-known in the art and one particularly familiar form of an extensible arm structure is the common "scissors" extension arm. The scissors extension arm involves at least a first pair of pivotally joined rigid members. The structure may also include additional pairs of rigid members adjoined to the ends of the first pair in an end-to-end relationship. Lateral movement of the free ends of the rigid members imparts a corresponding movement to the pivotally interconnected pairs of rigid members resulting in a linear contraction and/or extension of the scissors extension arm. While this well-known apparatus is found in numerous applications, it is generally considered to be a two-dimensional configuration and therefore lacks the necessary structural stability for various applications. Additionally, the nature of the construction limits the extension of the scissors extension arm to a generally straight line.

The foregoing limitations of a two-dimensional structure have been overcome by the apparatus disclosed in my previous patent, U.S. Pat. No. 4,155,975, issued Sept. 26, 1978. In this patent, the basic element of the foldable and extensible structure is a foldable and extensible base module. The base module is fabricated from six equal-length, rigid members swivelly interconnected end-to-end in a closed figure with intersecting rigid members being pivotally connected adjacent the midpoint of the rigid members. A plurality of the base modules are selectively interconnected at adjacent swivels and may include additional rigid struts to thereby provide an enlarged, foldable and extensible truss-like structure. However, in each of the configurations set forth in this patent, extension is limited to a straight line or plane and is, therefore, incapable of being extended in a curvilinear configuration.

Zeigler (U.S. Pat. No. 3,968,808) discloses a collapsible, self-supporting structure made up of a network of rod elements pivotally joined at their ends and forming scissor-like pairs in which rod element crossing points are pivotally joined.

Zeigler (U.S. Pat. No. 4,026,313) discloses a collapsible, self-supporting structure in which basic assemblies of crossed rod elements are employed to achieve the desired shape. Further, the crossing points of crossed rod element in the structure may include limited sliding connections to affect the transfer of collapsing force to other crossing points which are pivotally joined.

Lotto, et al (U.S. Pat. No. 4,017,932) discloses a temporary, modular, self-erecting bridge which is expandable to form a truss-like structure.

While the foregoing list of references have come to the attention of the inventor, no representation is made that all of these references may be "prior art" within the meaning of that term under the provisions of 35 USC 102 or 35 USC 103, although these references are disclosed herein so as to fully comply with the duty of candor and good faith as required in 37 CFR 1.56.

In view of the foregoing, it would be an advancement in the art to provide a foldable and extensible structure which is extensible in a generally curvilinear orientation, the curvature of the curvilinear configuration being a function of the length of the rigid members with a corresponding placement of the pivotal points on the structure, and the degree of extension of the structure. It would also be an advancement in the art to provide a novel foldable and curvilinearly extensible structure wherein the rigid members are configurated with a predetermined arcuate curve therein to thereby provide a predetermined toroidal profile to the structure.

BRIEF SUMMARY AND OBJECTS OF THE INVENTION

The present invention relates to a foldable and curvilinearly extensible structure fabricated from a plurality of basal modular elements with each basal modular element or base module being configurated from six rigid members flexibly joined end-to-end by swivels into a closed structure having a generally double, isosceles triangular profile when folded flat. The intersecting rigid members are pivotally interconnected.

The rigid members that form the base of the isosceles triangle are pivotally joined at their midpoint while the pivots for the other two sets of rigid members are each offset from the intervening swivels by a distance that equals one-half the length of the base or, correspondingly, are offset from the swivel by the same distance as the basal pivot.

It is, therefore, a primary object of this invention to provide improvements in foldable and curvilinearly extensible structures.

Another object of this invention is to provide improvements in the method of providing foldable and curvilinearly extensible structures.

Another object of this invention is to provide a foldable and curvilinearly extensible structure wherein a plurality of basal modular elements are selectively interconnected end-to-end for the purpose of providing a curvilinearly extensible structural element.

Another object of this invention is to provide a truss-like structure wherein a plurality of basal modular elements are selectively interconnected to provide a structure which is foldable and curvilinearly extensible into a truss structure having a generally cylindrical profile.

Another object of this invention is to combine rigid members having predetermined lengths to provide a foldable structure having a predetermined isosceles triangular profile and being curvilinearly extensible.

These and other objects and features of the present invention will become more fully apparent from the following description and appended claims taken in conjunction with the accompanying drawing.

DETAILED DESCRIPTION OF THE PREFERRED EMBODIMENTS

Figure 1:
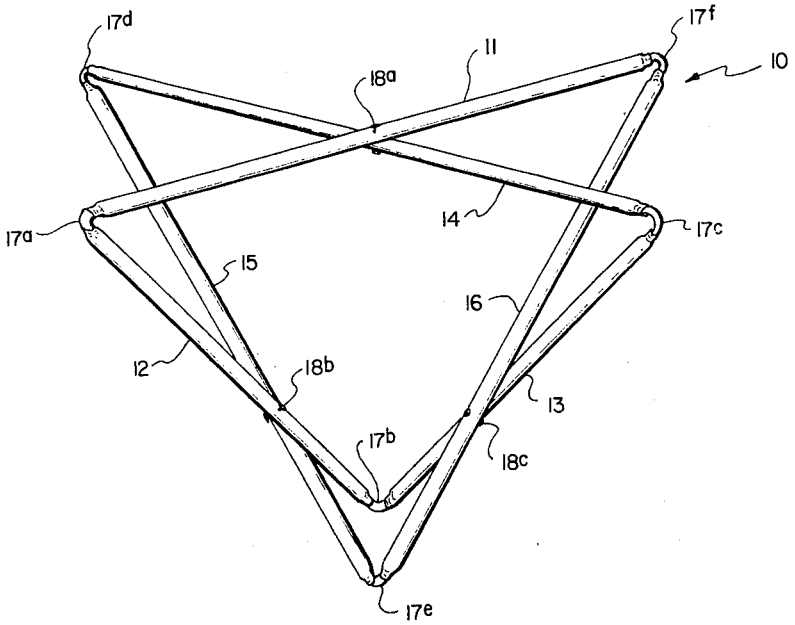
FIG. 1 is a perspective view of a basal modular element for a first preferred embodiment of this invention shown in the generally open or extended configuration.

The invention is best understood by reference to the drawing wherein like parts are designated by like numerals throughout.

Referring now to FIG. 1, a first preferred embodiment of the base module of this invention is shown generally at 10 and includes a plurality of rigid members 11–16 flexibly interconnected end-to-end by flexible swivels 17*a*–17*f*, respectively. Representative swivel arrangements are shown in my patent, U.S. Pat. No. 4,115,975 issued Sept. 26, 1978. Swivels 17*a*–17*f* provide the necessary twisting and hinge-type movement between the interconnected rigid members 11–16 when base module 10 is flexed between the flat and the extended configurations.

The respective lengths of adjoining pairs of rigid members 11–16 are selectively predetermined to thereby provide an essentially isosceles triangular profile when base module 10 is folded into a flat configuration. For example, rigid members 11 and 14 are provided with a length that is longer than the equal lengths of rigid members 12, 13, 15 and 16. This configuration presents a profile corresponding to an isosceles triangle with a wide base as represented by rigid members 11 and 14 so that the sides of the triangle represented by rigid members 12 and 15 on one side and rigid members 13 and 16 on the other side are essentially equal in length.

Rigid members 11 and 14 are pivotally interconnected by a pivot 18*a* while rigid members 12 and 15 are pivotally interconnected by a pivot 18*b* and rigid members 13 and 16 are pivotally interconnected by a pivot 18*c*. It will be noted that pivot 18*a* is located at the midpoint of each of rigid members 11 and 14. However, pivots 18*b* and 18*c* are offset a predetermined distance from the interceding swivels of the respective rigid members. The relationship between the lengths of the rigid members that form the isosceles triangle and the relationship between the location of the respective pivots can best be understood by reference to the schematic illustration of FIG. 10.

Figure 10:
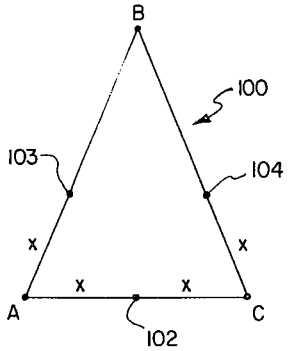
FIG. 10 is a diagramatic representation of the pivot points for the isosceles triangular configuration of the basal modular elements of this invention.

With particular reference now to FIG. 10, an isosceles triangle ABC is shown generally at 100 and has a base AC with equal sides represented by leg AB and leg BC. A pivot 102 is located at the midpoint of base AC so that the distance from pivot 102 to corner A is represented by distance x and likewise the distance from pivot 102 to corner C is also represented by the distance x. Importantly, pivot 103 is located distance x from corner A and pivot 104 is also located distance x from corner c. Any significant alteration of the relationship of the respective pivots from the foregoing relationship will interfere with the foldable and also the curvilinear extension characteristics of the structure of this invention.

While triangle ABC of FIG. 10 is shown with base AC shorter than coequal legs AB and BC, the foregoing relationship must be followed when base AC is longer than legs AB and BC. The only difference will be in the direction in which the structure will curve when unfolded.

Referring again to FIG. 1, the base of the isosceles triangle of base module 10 is represented by rigid members 11 and 14. Accordingly, it is to be clearly understood that pivot 18*b* is located equidistantly from swivels 17*a* and 17*d* as is pivot 18*a* from swivels 17*a* and 17*d*. Likewise, pivot 18*c* is also located equidistantly from swivels 17*c* and 17*f* along with pivot 18*a* from the same swivels.

Since the base represented by rigid members 11 and 14 is longer than the remaining rigid members, the foregoing relationship places pivots 18*b* and 18*c* closer to swivels 17*b* and 17*e*. The resulting placement of pivots 18*b* and 18*c* means that the assembled truss member, as will be discussed more fully hereinafter with respect to FIG. 2, will tend to place swivels 17*b* and 17*e* on an inside portion of the resultant curvilinear profile.

Attention should also be directed to the inside/outside relationship between the pivotally joined rigid members 11–16. In particular, the relationship alternates for each rigid member in the serial sequence. For example, rigid member 11 is pivotally connected to the outside of rigid member 14 whereas rigid member 12 is pivotally connected to the inside of rigid member 15. Correspondingly, rigid member 13 is pivotally connected to the outside of rigid member 16. The terms "inside" and "outside" have been arbitrarily chosen herein to designate the appropriate position relative to the internal structure of base module 10.

Figure 2:
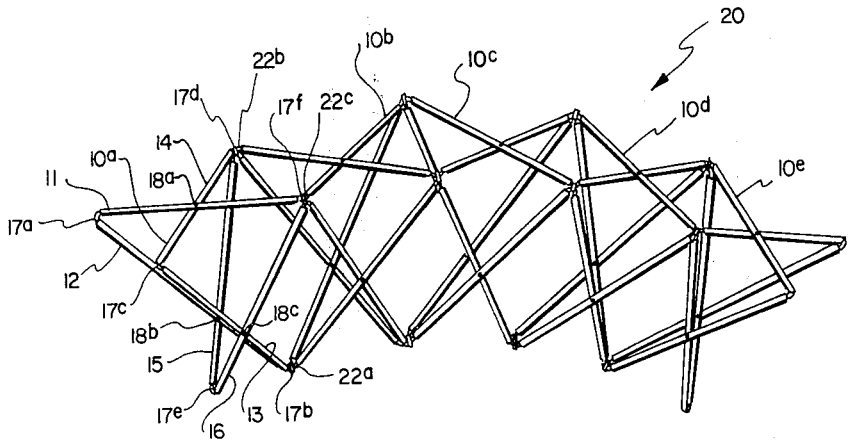
FIG. 2 is a perspective view of a plurality of the basal modular elements of FIG. 1 shown interconnected to provide a first preferred embodiment of the foldable and curvilinearly extensible structure of this invention.

Referring now also to FIG. 2, a plurality of base modules 10 (shown herein as base modules 10*a*–10*e*) are selectively interconnected in an end-to-end relationship to provide this one preferred embodiment of the foldable and curvilinearly extensible truss element 20 of this invention. In particular, swivels 17*b*, 17*d*, and 17*f* are flexibly interconnected with corresponding swivels of base module 10*b* in interties 22*a*–22*c*, respectively, thereby flexibly interconnecting base module 10*a* with base module 10*b*. Corresponding flexible interties are also made between each of base modules 10*b*–10*e* thereby providing the foldable and curvilinearly extensible truss-like structure 20. However, it should be pointed out that the foregoing inside/outside relationship between adjacent rigid members is alternated between successive base modules 10*a*–10*e*. This successive alternation corrects the tendency for the assembled truss element 20 to form a generally twisting characteristic in the structure. In particular, each of rigid members 11–16 are interconnected end-to-end and are foldable into a generally flat, double, isosceles triangular configuration. The double triangular configuration is composed of two isosceles triangles (when folded flat and viewed in plan view) with the first triangle including rigid members 11, 12 and 13 and the second triangle including rigid members 14, 15 and 16. However, since all of rigid members 11–16 are interconnected end-to-end, the overlying pairs of swivels (swivels 17*a* and 17*d*; swivels 17*b* and 17*e*; and swivels 17*c* and 17*f*) tend to be offset from each other by approximately the thickness of the respective rigid members. Therefore, in the absence of an alternating base module internal structure, the total structure of truss element 20 would tend to twist by an amount approximating the thickness of the rigid members of each base module to the next base module.

The degree of curvature of truss element 20 is a function of the relative lengths of the respective rigid members and the degree of extension of truss element 20. Accordingly, any person practicing the teachings of this invention will be able to use simple, well-known mathematical relationships to selectively predetermine the distance to be covered by truss element 20, the degree of desired curvature, and the degree of extension for the various base modules 10*a*–10*e* therein. These mathematical concepts are well-known in the art and are, therefore, not included herein for each of presentation and simplicity. The foregoing calculation will necessarily include a determination of the length of rigid members 11 and 14 for the purpose of providing the desired overall profile characteristics to truss structure 20. For example, increasing the length of rigid members 11 and 14 shifts the location of pivots 18*b* and 18*c* in the remaining rigid members and provides a corresponding change in the curvature of truss element 20. Correspondingly, foreshortened rigid members 11 and 14 relative to the remaining rigid members provides a corresponding alteration in the overall appearance of truss element 20.

Figure 3:
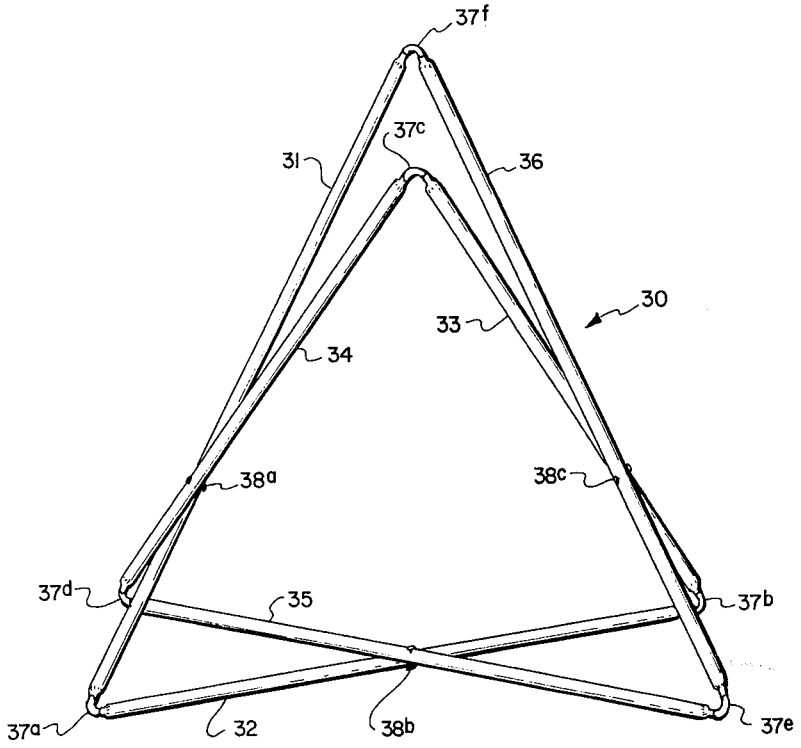
FIG. 3 is a perspective view of another preferred embodiment of the basal modular element of this invention shown in the partially opened configuration.

With reference now to FIG. 3, another preferred embodiment of the base module of this invention is shown as base module 30. Base module 30 differs from base module 10 (FIG. 1) primarily in the length of its base as defined by rigid members 32 and 35, as will be set forth more fully hereinafter.

Base module 30 is fabricated from a plurality of rigid members 31–36 serially interconnected end-to-end by swivels 37*a*–37*f*, respectively. Rigid members 32 and 35 are pivotally interconnected at their respective midpoints by pivot 38*b*. Pivot 38*a* pivotally interconnects rigid members 31 and 34 while pivot 38*c* pivotally interconnects rigid members 33 and 36. It should be particularly noted that pivot 38*a* is equidistantly located from swivels 37*a* and 37*d* along with pivot 38*b*. Correspondingly, pivot 38*c* is located equidistantly with pivot 38*b* from swivels 37*b* and 37*e*. This relationship is best seen by reference again to the foregoing discussion regarding the schematic illustration of FIG. 10.

The length of rigid members 32 and 35 in relation to the remaining rigid members, rigid members 31, 33, 34 and 36, in conjunction with the predetermined placement of pivots 38*a* and 38*c* imparts the desired curvilinear extension characteristics to a truss structure fabricated from a plurality of base modules 30 serially interconnected in an end-to-end relationship as will be set forth more fully hereinafter with respect to the discussion relating to FIG. 4.

Figure 4:
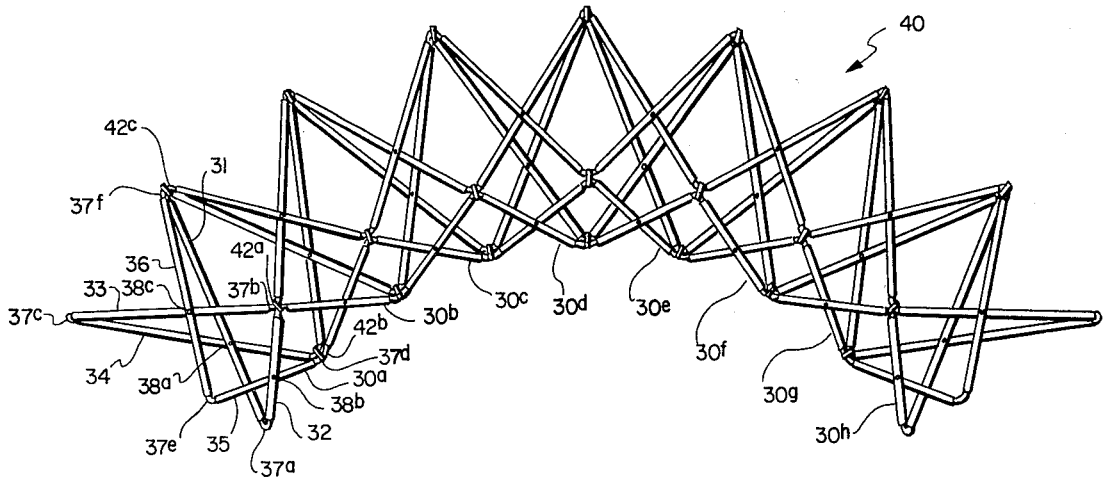
FIG. 4 is a perspective view of a plurality of basal modular elements of FIG. 1 interconnected to form another preferred embodiment of the foldable and curvilinearly extensible structure of this invention.

Referring now more particularly to FIG. 4, a truss element 40 is shown and is fabricated from a plurality of base modules similar to base module 30 (FIG. 3) and shown herein as base modules 30*a*–30*h*. In particular, swivels 37*b*, 37*d*, and 37*f* are interconnected with corresponding swivels of adjacent base module 30*b* to form interties 42*a*–42*c*, respectively. Corresponding interties are made between adjacent swivels of base modules 30*b*–30*h* to provide the curvilinearly extensible structure of truss element 40. However, as set forth hereinbefore with respect to FIGS. 1 and 2, each of base modules 30*a*–30*h* are sequentially alternated with respect to the "inside" and "outside" relationship between the intersecting rigid members.

The basal portion of truss structure 40, as represented by rigid members 32 and 35 (see also FIG. 3), forms a curvilinear surface which generally represents a segment of a cylindrical surface whereas the apex of the triangular configuration as represented by swivels 37*c* and 37*f* (see also FIG. 3) generally represents an arc which is substantially parallel to the cylindrical planar surface represented by rigid members 32 and 35. Accordingly, in comparison with truss element 20 (FIG. 2), truss element 40 is configurated with an arch-like inner surface corresponding to the cylindrical surface as represented by rigid members 32 and 35. On the other hand, the truss element 20 (FIG. 2) provides an outer cylindrical surface as represented by rigid members 11 and 14 as the outer surface to truss element 20.

The circular arch superintended by truss element 40 will, therefore, be a function of the length of rigid members 31, 33, 34 and 36 in relation to rigid members 32 and 35 which determines the location of pivots 38*a* and 38*c* in combination with the degree of extension of base modules 30*a*–30*h* that make up truss element 40.

Figure 5:
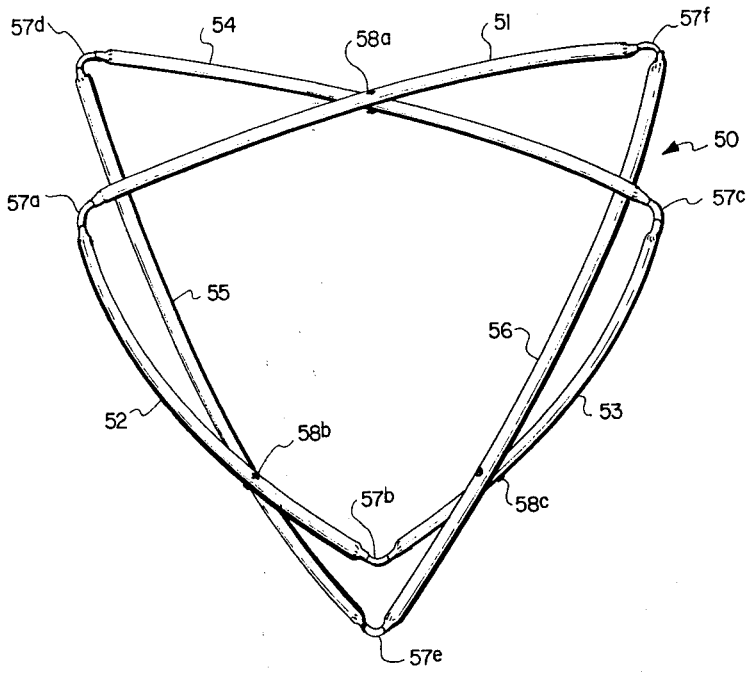
FIG. 5 is a perspective view of another preferred embodiment of the basal modular element of this invention showing each of the rigid members having a predetermined curved configuration.

Referring now more particularly to FIG. 5, another preferred embodiment of the novel base module of this invention is shown generally at 50 and includes a plurality of rigid members 51–56 serially interconnected in an end-to-end relationship by swivels 57*a*–57*f*, respectively. While base module 50 is substantially similar to the construction of base module 10 (FIG. 1) is should be particularly noted that each of rigid members 51–56 are formed with a predetermined curvature therein. The curvature of each of rigid members 51–56 is selectively oriented so that when base module 50 is folded into the generally flat or triangular configuration, the arcuate curvatures of corresponding pairs of rigid members 51 and 54; 52 and 55; and 53 and 56, are substantially parallel. In each instance, the curvature is outwardly from the center of the generally triangular configuration of flat folded base module 50.

Rigid members 51 and 54 form the "base" to the isosceles triangle represented by base module 50 when folded into a generally flat configuration and are pivotally joined at their respective midpoints. Rigid members 51 and 54 are also longer than the remaining equal length rigid members, rigid members 52, 53, 55, and 56. Thus, rigid members 52 and 55 are pivotally joined at a distance from swivels 57*a* and 57*d* equal to the distance that pivot 58*a* is located from swivels 57*a* and 57*d.* Correspondingly, rigid members 53 and 56 are pivotally joined at pivot 58*c* located at a distance from swivels 57*c* and 57*f* equal to the distance that pivot 58*a* is from swivels 57*c* and 57*f.* The respective lengths of rigid members 51 and 54 with respect to the lengths of rigid members 52, 53, 55, and 56 with the corresponding placement of pivots 58*b* and 58*c,* imparts the desired curvilinear characteristic to truss element 60 (FIG. 6) similar to that found in base module 10 in its relationship to truss element 20 (FIG. 2) as set forth hereinbefore.

Figure 6:
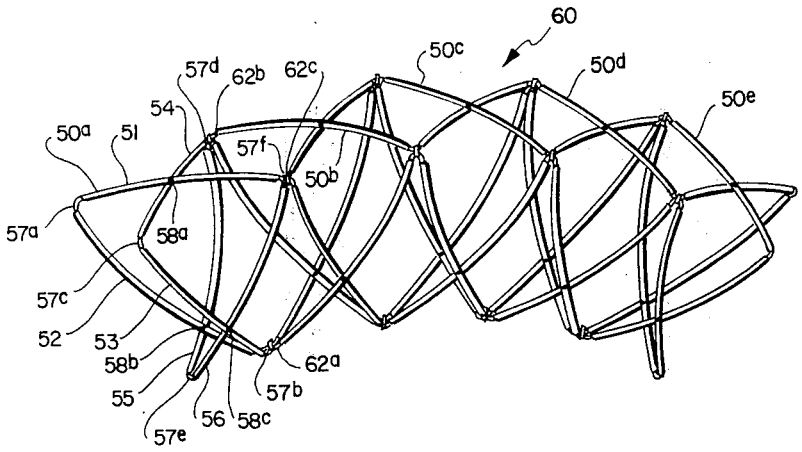
FIG. 6 is a perspective view of a plurality of modular elements of FIG. 5 interconnected end-to-end to provide another preferred embodiment of the foldable and curvilinearly extensible structure of this invention.

With particular reference to FIG. 6, truss element 60 is shown as fabricated from a plurality of base modules 50*a*–50*e* similar to base module 50 (FIG. 5). Base module 50*a* is flexibly interconnected in an end-to-end relationship to base module 50*b* by flexibly interconnecting swivels 57*b,* 57*d* and 57*f* to corresponding swivels on base module 50*b* in interties 62*a*–62*c.* Corresponding interconnection is made between the successive base modules 50*d*–50*e,* respectively. Accordingly, truss element 60 is foldable and curvilinearly extensible in a generally curvilinear profile substantially identical to the extension of truss element 20 (FIG. 2). Additionally, the degree of curvature of truss element 60 in the extension thereof will be a function of the respective length relationships between rigid members 51 and 54 with respect to rigid members 52, 53, 55, and 56. The resultant length of rigid members 51 and 54 will selectively predetermine the location of pivots 58*b* and 58*c.* These features combined with the number and degree of extension of base modules 50*a*–50*e* will selectively determine the arch superintended by truss element 60.

Importantly, however, it should be noted that the arcuate profile of each of rigid members 51–56 also imparts an overall toroidal contour to the internal portion of truss element 60 when truss element 60 is extended into a predetermined degree of extension. The interrelationship between the extension of truss element 60 to obtain the toroidal profile will, therefore, also be a function of the curvature of each of rigid members 51–56. The formation of a generally toroidal surface by truss element 60 would provide a useful structure for supporting an internally placed toroidal surface (not shown) for any suitable purpose. Additionally, the internal relationship between adjacent base modules 50*a*–50*e* will be selectively alternated to preclude the previously discussed "twisting" of truss element 60.

Figure 7:
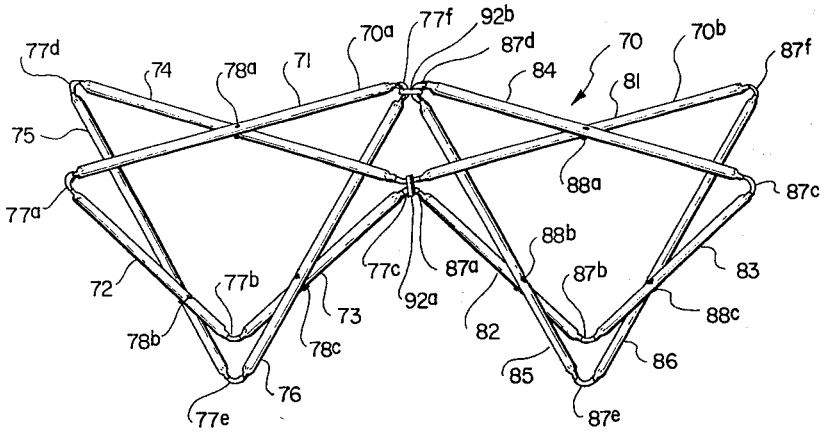
FIG. 7 is a perspective view of a pair of modular elements joined side by side.

Referring now to FIG. 7, another basal element of the truss structure of this invention is shown wherein a pair of base modules 70*a* and 70*b* are joined in a side-to-side relationship through flexible interties 92*a* and 92*b.* In particular, base module 70*a* is fabricated from a plurality of rigid members 71–76 flexibly interconnected in an end-to-end relationship by swivels 77*a*–77*f,* respectively. Rigid members 71 and 74 are pivotally interconnected at their respective midpoints by pivot 78*a.* Rigid member 72 is pivotally interconnected to rigid member 75 by pivot 78*b* while rigid member 73 is pivotally interconnected to rigid member 76 by swivel 78*c.* Swivels 78*b* and 78*c* are located so that the respective distance from the adjacent swivel between it and swivel 78*a* is the same to thereby impart the desired curvilinear characteristics to the truss structure as will be set forth more fully hereinafter and as also set forth hereinbefore with respect to each of the structures of this invention. Base module 70*b* is fabricated from a plurality of rigid members 81–86 flexibly interconnected in an end-to-end relationship by swivels 87*a*–87*f,* respectively. Correspondingly, rigid members 81 and 84 are pivotally interconnected by pivot 88*a* adjacent their midpoint. Pivot 88*b* pivotally joins rigid members 82 and 85 while rigid members 83 and 86 are pivotally joined by pivot 88*c.* The placement of pivot 88*b* relative to rigid members 82 and 85 is such that the distance from pivot 88*b* to swivels 87*a* and 87*d* is equal to the distance from pivot 88*a* to these same swivels. Pivot 88*c* is likewise located on rigid members 83 and 86 equidistantly with pivot 88*a* from swivels 87*c* and 87*f.*

Intertie 92*a* flexibly interconnects swivel 77*c* of base module 70*a* with swivel 87*a* of base module 70*b.* Correspondingly, intertie 92*b* flexibly interconnects swivel 77*f* of base module 70*a* with swivel 87*d* of base module 70*b.* The particular orientation of base module 70*a* to base module 70*b* is such that rigid members 71 and 74 of base module 70*a* in cooperation with rigid members 81 and 84 of base module 70*b* define a generally planar configuration across the corresponding surface of base modules 70*a* and 70*b.* Additional base modules (not shown), comparable to base modules 70*a* and 70*b,* can be joined also in a side-to-side relationship therewith to further extend laterally the basal structure 70. For example, additional interties may be made with swivel 77*a* and 77*d* of base module 70*a* in addition to swivels 87*c* and 87*f* of base module 70*b.*

Figure 8:
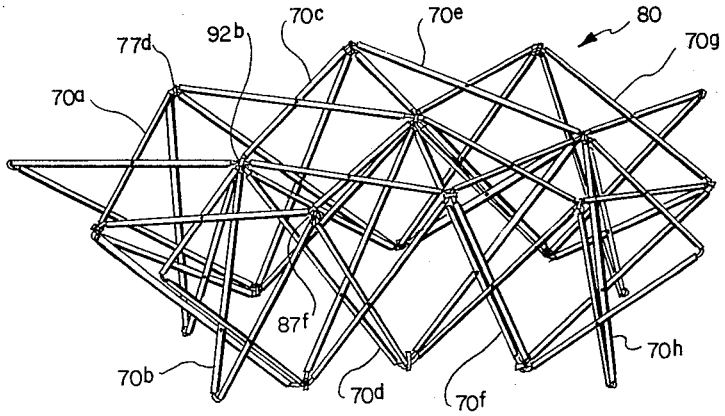
FIG. 8 is a perspective view of a plurality of pairs of modular elements of FIG. 7 interconnected in another preferred embodiment of the foldable and curvilinearly extensible truss structure of this invention to create a vault-like structure having a generally cylindrical profile.

Referring now more particularly to FIG. 8, another preferred truss structure embodiment of this invention is shown generally at 80 and is fabricated from a plurality of basal elements such as basal element 70 (FIG. 7) (fabricated from base modules 70*a* and 70*b*) flexibly joined in an end-to-end relationship with additional basal elements. For example, base modules 70*a* and 70*b* are joined in a side-to-side relationship (see also FIG. 7) and are, in turn, flexibly joined end-to-end with corresponding base modules 70*c* and 70*d,* respectively. Additionally, base modules 70*c* and 70*d* are flexibly joined end-to-end with base modules 70*e* and 70*f,* respectively, while base modules 70*g* and 70*h,* respectively, are flexibly joined therewith. Accordingly, the planar configuration defined by rigid members 71 and 74 in conjunction with rigid members 81 and 84 (FIG. 7) becomes a substantially widened cylindrical surface when truss structure 80 is curvilinearly extended. The curvature of the resulting cylindrical surface is a function of the various features set forth hereinbefore.

Truss structure 80 is shown as being fabricated from base modules 70*a* and 70*b* (FIG. 7) which are similar in construction to base module 10 (FIG. 1) so that truss structure 80 is then generally similar in its basic construction to truss element 20 (FIG. 2).

Therefore, it will be seen that the configuration of truss structure 80 is substantially identical to truss element 20 (FIG. 2) with the exception that truss structure 80 consists of two side-by-side truss elements similar to truss element 20 (FIG. 2) joined in a side-to-side relationship. However, a similar configuration for truss structure 80 may also be prepared using the combination of features relative to the structure of base module 30 (FIG. 3) as the basal element for a plurality of truss elements similar to truss element 40 (FIG. 4). Correspondingly, truss structure 80 may also be prepared from a combination of base modules 50 (FIG. 5) connected into a plurality of joined truss elements similar to truss element 60 (FIG. 6). In any of these configurations, the length of the base of the triangular (isosceles) profile relative to the two legs predetermines the placement of the respective pivots in those legs and, thereof, the curvature characteristics of the particular truss element or truss structure.

Figure 9:
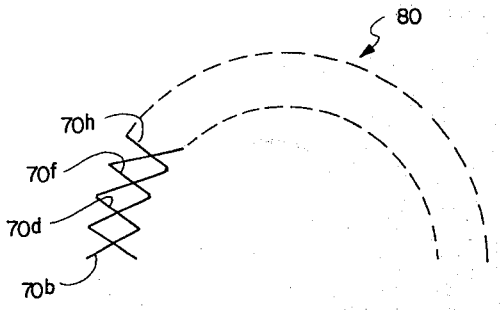
FIG. 9 is a schematic, side elevation of the truss structure of FIG. 8 to more clearly illustrate the cylindrical curvature of the curvilinearly extensible structure.

With reference now to FIG. 9, trus structure 80 is indicated schematically as extending in a semicircular arch to provide thereby a semicylindrical vault. This figure is included herein primarily for the purpose of showing the arch-forming characteristics of truss structure 80 of FIG. 8 when viewed in a side elevation. The broken lines schematically illustrate the continuum formed when the overall truss structure is extended with additional basal elements similar to basal element 70 (FIG. 7).

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by a U.S. Letters Patent is:

1. A foldable and curvilinearly extensible structure comprising:

a plurality of base modules, each base module comprising six rigid members flexibly interconnected end-to-end in a closed figure with the closed figure being configurated with:

one end of the first rigid member swivelly interconnected to one end of a second rigid member in a first swivel;

the other end of the second rigid member swivelly interconnected to one end of a third rigid member in a second swivel;

the other end of the third rigid member swivelly interconnected to one end of a fourth rigid member in a third swivel;

the other end of the fourth rigid member swivelly interconnected to one end of a fifth rigid member in a fourth swivel;

the other end of the fifth rigid member swivelly interconnected to one end of a sixth rigid member in a fifth swivel;

the other end of the sixth rigid member swivelly interconnected to the other end of the first rigid member in a sixth swivel;

each base module further including the first rigid member pivotally connected to the inside of the fourth rigid member in a first pivot, the second member pivotally connected to the outside of the fifth rigid member in a second pivot and the third rigid member pivotally connected to the inside of the sixth rigid member in a third pivot, the first and fourth rigid members having a first length while the second, third, fifth and sixth rigid members have a second length, the first pivot being located at the midpoint of the first and fourth rigid members while the second and third pivots are equidistantly located on their respective rigid members at a location from the swivel between the first pivot and the respective second and third pivots corresponding to one-half the length of the first and fourth rigid members; and said foldable and curvilinearly extensible structure comprising flexibly and serially interconnected base modules, wherein the first base module is flexibly interconnected to a second base module by flexibly joining the first, third and fifth swivels of the first base module to the second, fourth and sixth swivels of the second base module, respectively, and the second base module is flexibly interconnected to a third base module by flexibly joining the first, third and fifth swivels of the second base module to the second, fourth and sixth swivels of the third base module, respectively, thereby swivelly and flexibly interconnecting a plurality of base modules to form the foldable and curvilinearly extensible structure, the curvilinear contour of the extended structure being selectively predetermined by the relative lengths of the respective rigid members and the degree of extension of the structure, the structure being foldable into a relatively flat configuration having a generally isosceles triangular outline.

2. The foldable and curvilinearly extensible structure defined in claim 1 wherein the first and fourth rigid members have a length less than the length of the second, third, fifth and sixth rigid members.

3. The foldable and curvilinearly extensible structure defined in claim 1 wherein the first and fourth rigid members have a length greater than the length of the second, third, fifth and sixth rigid members.

4. The foldable and curvilinearly extensible structure defined in claim 1 further comprising:

a fourth base module flexibly interconnected to the first base module by flexibly interconnecting the fourth swivel of the fourth base module with the second swivel of the first base module and the first swivel of the fourth base module with the fifth swivel of the first base module and also the second swivel of the second base module and correspondingly interconnecting additional base modules into a curvilinearly extensible truss-like structure, the truss-like structure being generally foldable into a structure having a contour characterized as a plurality of interconnected triangles and curvilinearly extensible into a vault-like configuration.

5. The foldable and curvilinearly extensible structure defined in claim 1 wherein each rigid member is configurated with a predetermined curvature with the curvature of each rigid member corresponding to the curvature of the rigid member to which it is pivotally joined.

6. A foldable and curvilinearly extensible truss structure comprising:

a plurality of base modules, each base module comprising six rigid members flexibly interconnected end-to-end in a closed figure with the closed figure being configurated with:

one end of a first rigid member swivelly interconnected to one end of a second rigid member in a first swivel;

the other end of a second rigid member swivelly interconnected to one end of a third rigid member in a second swivel;

the other end of the third rigid member swivelly interconnected to one end of a fourth rigid member in a third swivel;

the other end of the fourth rigid member swivelly interconnected to one end of a fifth rigid member in a fourth swivel;

the other end of the fifth rigid member swivelly interconnected to one end of a sixth rigid member in a fifth swivel;

the other end of the sixth rigid member swivelly interconnected to the other end of the first rigid member in a sixth swivel;

each base module including the first rigid member pivotally connected to the inside of the fourth rigid member in a first pivot, the second rigid member pivotally connected to the outside of the fifth rigid member in a second pivot and the third rigid member pivotally connected to the inside of the sixth rigid member in a third pivot, the first pivot being made adjacent the midpoint of the first and fourth rigid members, the first and fourth rigid members having a first length while the second, third, fifth and sixth rigid members have a second length, the first pivot being located at the midpoint of the first and fourth rigid members while the second and third pivots are equidistantly located on their respective rigid members at a location from the swivel between the first pivot and the respective second and third pivots corresponding to one-half the length of the first and fourth rigid members to thereby impart a predetermined curvilinearly extensible truss structure when extended from the folded state;

the truss structure comprising a plurality of truss members, each truss member including a first base module interconnected to at least a second base module to thereby form an extensible truss member, the truss member being curvilinearly extensible, the first swivel of the first base module being flexibly interconnected to the fourth swivel of the second base module in a first intertie, a third swivel of the first base module being flexibly interconnected to the sixth swivel of the second base module in a second intertie and a fifth swivel of the first base module is flexibly interconnected to the second swivel of the second base module in a third intertie, thereby forming the first truss member, the truss structure comprising a second truss member flexibly interconnected to the first truss member with a first base module of the first truss member interconnected to the first base module of the second truss member wherein the second swivel of the first base module of the first truss member is flexibly interconnected to the fourth swivel of the first base module of the second truss member and the fifth swivel of the first base module of the first truss member is flexibly interconnected to the first swivel of the first base module of the second truss member thereby providing a curvilinearly extensible truss member.

7. A method for providing a curvilinearly extensible structure comprising:

fabricating a base module comprising six rigid members flexibly interconnected end-to-end in a closed figure with the closed figure being configurated with:

one end of the first rigid member swivelly interconnected to one end of a secnd rigid member in a first swivel;

the other end of the second rigid member swivelly interconnected to one end of a third rigid member in a second swivel;

the other end of the third rigid member swivelly interconnected to one end of a fourth rigid member in a third swivel;

the other end of the fourth rigid member swivelly interconnected to one end of a fifth rigid member in a fourth swivel;

the other end of the fifth rigid member swivelly interconnected to one end of the sixth rigid member in a fifth swivel;

the other end of the sixth rigid member swivelly interconnected to the other end of the first rigid member in a sixth swivel;

pivotally connecting the first rigid member to the inside of the fourth rigid member in a first pivot, the second rigid member pivotally to the outside of the fifth rigid member in a second pivot and the third rigid member to the inside of the sixth rigid member in a third pivot, the first and fourth rigid members having a first length while the second, third, fifth and sixth rigid members have a second length, the first pivot being located at the midpoint of the first and fourth rigid members while the second and third pivots are equidistantly located on their respective rigid members at a location from the swivel between the first pivot and the respective second and third pivots corresponding to one-half the length of the first and fourth rigid members; and interconnecting a first base module to a second base module by flexibly interconnecting a first swivel of the first base module with a fourth swivel of the second base module, the fifth swivel of the first base module with the second swivel of the second base module and the third swivel of the first base module with the sixth swivel of the second base module, the foldable and curvilinearly extensible structure thereby providing a curvilinear profile when extended and a substantially isosceles triangular profile when folded.

8. The method defined in claim 7 wherein the interconnecting step further comprises joining a second truss member to the first truss member by flexibly interconnecting the second swivel of the first base module with a fourth swivel of a second base module and a fifth swivel of the first base module with a first swivel of the second base module, thereby adjoining truss members that are curvilinearly extensible and foldable into a structure having a general configuration of triangles having a common planar element and appearing as double triangles.

9. The method defined in claim 7 wherein the fabricating step comprises selecting the first and fourth rigid members with a length greater than the length of the secnd, third, fifth and sixth rigid members.

10. The method defined in claim 7 wherein the fabricating step comprises selecting the first and fourth rigid members with a length less than the length of the second, third, fifth and sixth rigid members.

* * * * *